US009956784B2

(12) United States Patent
Kumagai et al.

(10) Patent No.: US 9,956,784 B2
(45) Date of Patent: May 1, 2018

(54) LIQUID EJECTING APPARATUS AND LIQUID SUPPLY METHOD

(71) Applicant: SEIKO EPSON CORPORATION, Tokyo (JP)

(72) Inventors: Masaru Kumagai, Shiojiri (JP); Hirokazu Ono, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 53 days.

(21) Appl. No.: 15/177,604

(22) Filed: Jun. 9, 2016

(65) Prior Publication Data

US 2017/0008293 A1 Jan. 12, 2017

(30) Foreign Application Priority Data

Jul. 6, 2015 (JP) ..... 2015-135028

(51) Int. Cl.
*B41J 2/175* (2006.01)
*B41J 29/38* (2006.01)

(52) U.S. Cl.
CPC ..... *B41J 2/175* (2013.01); *B41J 2/17566* (2013.01); *B41J 29/38* (2013.01); *B41J 2/17503* (2013.01)

(58) Field of Classification Search
CPC .... B41J 2/175; B41J 2/17566; B41J 2/17503; B41J 29/38
See application file for complete search history.

(56) References Cited

U.S. PATENT DOCUMENTS

2005/0035985 A1 2/2005 Taguchi et al.
2007/0076063 A1* 4/2007 Ohnishi ..... B41J 2/17509 347/86
2008/0297579 A1* 12/2008 Umeda ..... B41J 2/175 347/92
2014/0292952 A1* 10/2014 Uchiyama ..... B41J 2/17509 347/85

FOREIGN PATENT DOCUMENTS

JP 2004-230857 8/2004
JP 2005-053151 3/2005
JP 2005-088568 4/2005
JP 2014-076596 * 5/2014 ..... B41J 2/175

* cited by examiner

*Primary Examiner* — Manish S Shah
*Assistant Examiner* — Yaovi M Ameh
(74) *Attorney, Agent, or Firm* — Workman Nydegger

(57) ABSTRACT

A liquid ejecting apparatus includes an ejecting head through which liquid is ejected. A supply passage connects the ejecting head to a plurality of liquid storage bodies that include a first liquid storage body to be used first and a second liquid storage body to be used following the use of the first liquid storage body. A supply mechanism discharges the liquid contained in the liquid storage bodies to the supply passage. When the supply mechanism discharges the liquid contained in the first liquid storage body to the supply passage on the basis of first energy, if the amount of liquid left in the first liquid storage body is smaller than a threshold amount, the supply mechanism discharges the liquid contained in the second liquid storage body to the supply passage on the basis of second energy, which is lower than the first energy.

6 Claims, 7 Drawing Sheets

LIQUID EJECTING APPARATUS AND LIQUID SUPPLY METHOD

BACKGROUND

1. Technical Field

The present invention relates to a liquid ejecting apparatus, such as a printer, and a liquid supply method.

2. Related Art

JP-A-2005-53151 discloses an ink jet printer, which is an example of a liquid ejecting apparatus. In this ink jet printer, when ink is supplied from a first ink cartridge during a printing operation, if the remaining amount of ink is insufficient, ink is further supplied from a second ink cartridge. Then, the inks supplied from the first and second ink cartridges are used together.

If the first ink cartridge is switched to the second ink cartridge after the ink in the first ink cartridge has been used up, the ink in the first ink cartridge can be used efficiently. However, if the ink in the first ink cartridge is used up in the course of a printing operation, the ink jet printer needs to interrupt this printing operation in order to switch from the first ink cartridge to the second ink cartridge.

If ink is supplied from the second ink cartridge before the ink in the first ink cartridge is used up, as described in the above document, the printing operation does not need to be interrupted. In this case, however, it is difficult to use the ink in the ink cartridges efficiently.

In general, such disadvantages are common to not only printers that perform a printing operation by ejecting ink but also other apparatuses in which liquids are supplied from a plurality of liquid storage bodies.

SUMMARY

An advantage of some aspects of the invention is that a liquid ejecting apparatus and a liquid supply method make it possible to, when liquid is supplied from a plurality of liquid storage bodies, switch between the liquid storage bodies without interrupting the supply of the liquid and to efficiently use liquid in the liquid storage bodies.

A description will be given below of functions and effects of a liquid ejecting apparatus and a liquid supply method according to aspects of the invention.

A first aspect of the invention provides a liquid ejecting apparatus that includes an ejecting head through which liquid is ejected. A supply passage connects the ejecting head to a plurality of liquid storage bodies that include a first liquid storage body to be used first and a second liquid storage body to be used following the use of the first liquid storage body. A supply mechanism discharges the liquid contained in the liquid storage bodies to the supply passage. When the supply mechanism discharges the liquid contained in the first liquid storage body to the supply passage on the basis of first energy, if the amount of liquid left in the first liquid storage body is smaller than a threshold amount, the supply mechanism discharges the liquid contained in the second liquid storage body to the supply passage on the basis of second energy, which is lower than the first energy.

According to this configuration, when the amount of liquid left in the first liquid storage body is smaller than the threshold amount, the supply mechanism additionally supplies the liquid from the second liquid storage body. Therefore, before the liquid in the first liquid storage body is used up, the liquid ejecting apparatus can switch from the supply of the liquid from the first liquid storage body to the supply of the liquid from the second liquid storage body without interrupting the ejecting of the liquid. Furthermore, when the liquid is additionally supplied from the second liquid storage body, the liquid left in the first liquid storage body is discharged therefrom on the basis of energy higher than that applied to the second liquid storage body. Thus, the liquid is supplied from the first liquid storage body more powerfully than that from the second liquid storage body. As a result, the liquid in the first liquid storage body can be almost completely consumed. In sum, the above configuration enables a liquid ejecting apparatus to, when liquid is supplied from a plurality of liquid storage bodies, switch between the liquid storage bodies without interrupting the supply of the liquid and to efficiently use the liquid in the liquid storage bodies that have been used.

The foregoing liquid ejecting apparatus preferably includes a detector that detects whether the amount of liquid left in the liquid storage bodies is smaller than the threshold amount by detecting a change in pressure of the liquid in the supply passage.

To give an example, if determining whether the amount of liquid left in a liquid storage body is smaller than a threshold amount on the basis of the consumption of liquid, the liquid ejecting apparatus may fail to sufficiently supply the liquid. This is because the actual remaining amount of liquid might be smaller than the estimated remaining amount due to an estimation error. To give another example, if determining whether the amount of liquid left in a liquid storage body is smaller than a threshold amount on the basis of a flow rate of the liquid, the liquid ejecting apparatus may also fail to sufficiently supply the liquid, for example, due to variations in the capacities of the liquid storage bodies. In contrast, according to the foregoing configuration, the detector detects whether the amount of liquid left in the liquid storage bodies is smaller than the threshold amount by detecting a change in pressure of the liquid in the supply passage. Therefore, this configuration successfully supplies the liquid at an appropriate pressure, independently of an error of a consumption of the liquid and variations in the capacities of the liquid storage bodies.

In the foregoing liquid ejecting apparatus, the supply passage preferably includes: a connection passage that interconnects the plurality of liquid storage bodies; and a joint passage that connects the connection passage to the ejecting head. When the liquid is ejected onto a medium, the supply mechanism preferably supplies the liquid at a high pressure by selectively applying pressure to the plurality of liquid storage bodies. After the liquid has been ejected onto the medium, the supply mechanism preferably discharges the liquid from the first liquid storage body to the second liquid storage body through the connection passage by removing the pressure applied to the second liquid storage body and by continuing to apply the pressure to the first liquid storage body.

According to this configuration, when the liquid is ejected onto the medium, the supply mechanism supplies the liquid at a high pressure by selectively applying pressure to the plurality of liquid storage bodies. If the amount of liquid left in the first liquid storage body is insufficient in the course of ejecting the liquid, the supply mechanism additionally supplies the liquid from the second liquid storage body by starting applying pressure to the second liquid storage body. Thus, when no liquid is about to be left in the first liquid storage body, the configuration successfully replaces the first liquid storage body with the second liquid storage body without interrupting ejecting of liquid. Moreover, after the liquid ejecting apparatus has ejected liquid onto the medium, the configuration removes the pressure applied to the second liquid storage body, thereby discharging the liquid in the first liquid storage body to which the pressure is still applied to the second liquid storage body through the connection passage. This can minimize the liquid left in the first liquid storage body that has been used and can perform a pressure applying operation efficiently by applying pressure to only the second liquid storage body when the liquid ejecting apparatus ejects liquid to the medium next time.

In the foregoing liquid ejecting apparatus, the supply passage preferably includes a plurality of introduction passages connected to the respective liquid storage bodies and a joint passage connecting the plurality of introduction passages to the ejecting head. Each of the introduction passages is preferably provided with an on-off valve. The joint passage is provided with a liquid reservoir that temporarily stores the liquid. When the ejecting head ejects the liquid onto the medium with the on-off valve being open in one of the introduction passages which is connected to the first liquid storage body, if the amount of liquid left in the first liquid storage body is smaller than the threshold amount, the on-off valve in one of the introduction passages which is connected to the second liquid storage body is preferably opened, and the supply mechanism preferably additionally supplies the liquid from the second liquid storage body. After a predetermined time has elapsed from the ejection of the liquid onto the medium, the on-off valve in the introduction passage connected to the first liquid storage body is preferably closed.

According to this configuration, when the liquid in the first liquid storage body is smaller than the threshold amount upon ejecting of liquid onto the medium, the on-off valve in the introduction passage connected to the second liquid storage body is opened, thereby allowing the liquid to flow out from the second liquid storage body to the joint passage. Furthermore, the on-off valve in the introduction passage connected to the first liquid storage body is opened upon ejecting of liquid onto the medium, thereby allowing the liquid to flow out from the first liquid storage body to the joint passage. Then, after a predetermined time has elapsed from the ejection of the liquid, the on-off valve in the introduction passage connected to the first liquid storage body is closed. During this elapsed time, the liquid left in the first liquid storage body flows out to the liquid reservoir provided in the joint passage. In this way, the configuration successfully minimizes the amount of liquid left in the first liquid storage body that has been used.

The liquid ejecting apparatus preferably further includes an annunciator that reports whether the amount of liquid left in the liquid storage bodies is smaller than the threshold amount. When the amount of liquid left in at least one of the liquid storage bodies is smaller than the threshold amount, the annunciator preferably gives a report after a predetermined time has elapsed from the ejection of the liquid onto the medium.

According to this configuration, the annunciator does not give a report immediately after the amount of liquid left in at least one of the liquid storage bodies is smaller than the threshold amount. Instead, the annunciator gives a report after a predetermined time has elapsed from the ejection of the liquid onto the medium. During this elapsed time, the liquid left in the liquid storage body is consumed.

A second aspect of the invention provides a liquid supply method of supplying liquid from a plurality of liquid storage bodies. The liquid storage bodies include a first liquid storage body to be used first and a second liquid storage body to be used following the use of the first liquid storage body. The liquid supply method includes: supplying the liquid contained in the first liquid storage body on the basis of first energy; and additionally supplying the liquid contained in the second liquid storage body on the basis of second energy when the amount of liquid left in the first liquid storage body is smaller than a threshold amount, the second energy being lower than the first energy.

According to this configuration, it is possible to produce the same functions and effects as the liquid ejecting apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
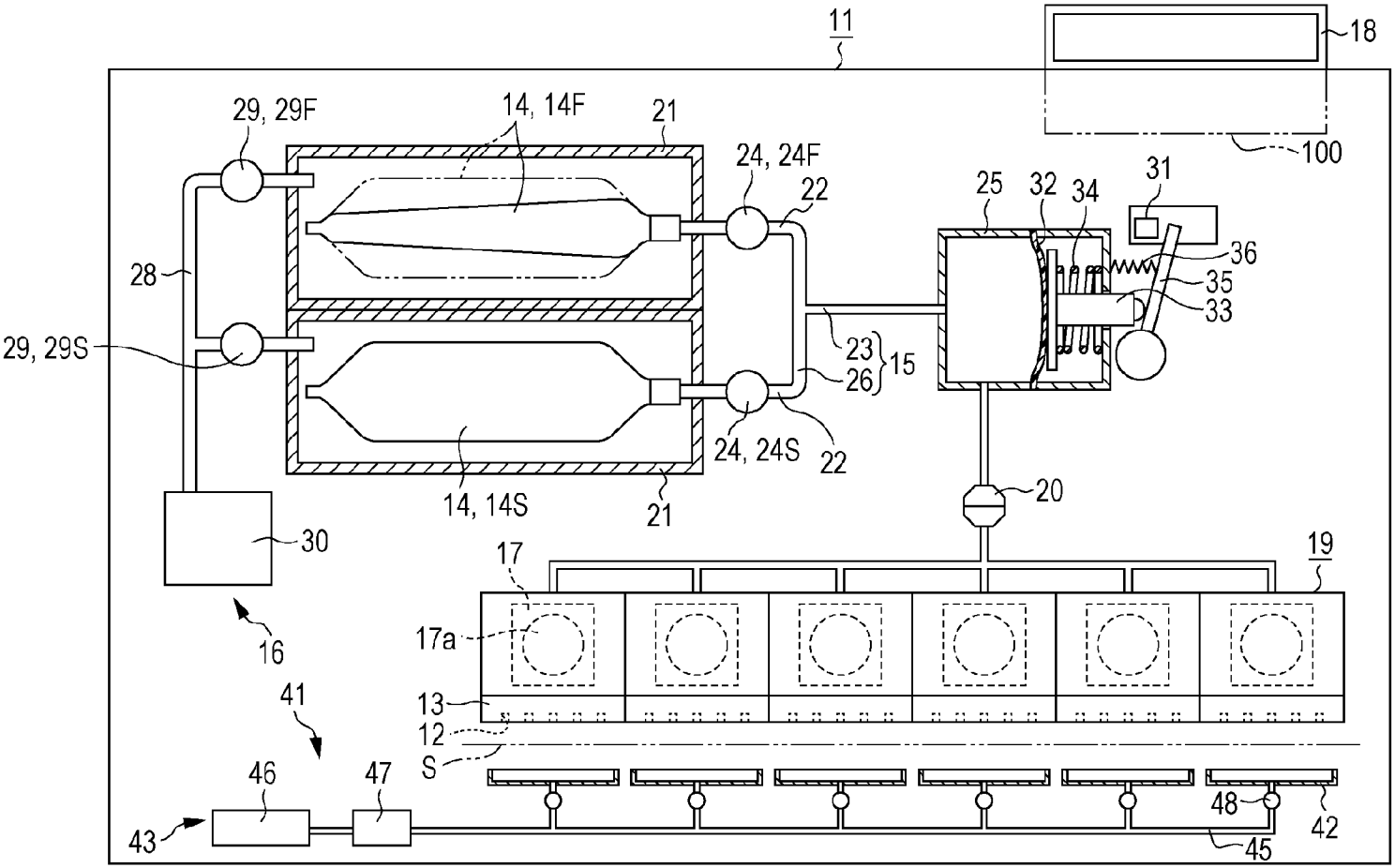
FIG. 1 schematically illustrates a cross section of a liquid ejecting apparatus in an embodiment of the invention.

A description will be given below of an embodiment of a liquid ejecting apparatus and its modifications, with reference to the accompanying drawings. As illustrated in FIG. 1, a liquid ejecting apparatus 11 includes a plurality of ejecting heads 13, each of which has a plurality of nozzles 12 through which liquid is to be ejected. Each ejecting head 13 is connected to a plurality of liquid storage bodies 14 via a supply passage 15. A plurality of pressure adjusting mechanisms 17 adjust the pressures of the liquid supplied to the ejecting heads 13. The liquid ejecting apparatus 11 further includes a supply mechanism 16 and an annunciator 18. The annunciator 18 gives a notice to a user by displaying an operating condition or state of the liquid ejecting apparatus 11; the annunciator 18 may be implemented using a display device provided with a liquid crystal panel, for example. The liquid ejecting apparatus 11 further includes a maintenance apparatus 41 that maintains the ejecting heads 13 and a controller 100. The controller 100 controls constituent elements of the liquid ejecting apparatus 11.

The liquid ejecting apparatus 11 may be an ink jet printer that records (prints) documents or other information on a medium S, such as a paper sheet, by ejecting ink onto the medium S through the ejecting heads 13 while moving the medium S in a transport direction. In the liquid ejecting apparatus 11, the ejecting heads 13 and the pressure adjusting mechanisms 17 constitute a liquid ejector 19. The liquid ejector 19 may be a line scan head in which the ejecting heads 13 are arranged side by side such that the printing area covers the whole width of the medium S. In addition, a filter 20 that cleans the liquid is preferably provided in the supply passage 15 on the upstream side of the pressure adjusting mechanisms 17.

Each liquid storage body 14 may be a liquid storage bag housed in a container 21, for example. More specifically, each liquid storage body 14 may be made of a flexible bag that contains liquid. The liquid storage bodies 14 are housed in respective containers 21, thereby forming cartridges, which are detachably attached to the liquid ejecting apparatus 11. These cartridges are related to types of liquid (colors of ink in this embodiment).

In this embodiment, a plurality of (e.g., three) cartridges are detachably attached to the liquid ejecting apparatus 11; two of the cartridges contain the same liquid (e.g., black ink), and the remaining one contains a different liquid. However, an arbitrary number of cartridges may be attached to the liquid ejecting apparatus 11 in relation to types of liquid used. Alternatively, the containers 21 may be fixed to the liquid ejecting apparatus 11, and removable liquid storage bodies 14 may be housed in the containers 21.

The supply mechanism 16 applies pressure to one or both of the liquid storage bodies 14 (14F and 14S) that contain the same liquid, thereby discharging the liquid contained in one or both of the liquid storage bodies 14 to the supply passage 15. In this way, the liquid is supplied to the pressure adjusting mechanisms 17 disposed downstream of the supply passage 15. Hereinafter, one of the liquid storage bodies 14 (14F and 14S) which is to be used first is referred to as a first liquid storage body 14F, and the remaining one of the liquid storage bodies 14 (14F and 14S) which is to be used following the use of the first liquid storage body 14F is referred to as a second liquid storage body 14S. If the liquid in the first liquid storage body 14F is used up and replaced with a new one, the second liquid storage body 14S to be used next becomes a first liquid storage body 14F and the new liquid storage body becomes a second liquid storage body 14S.

The supply passage 15 includes, for example, a plurality of introduction passages 22 and a joint passage 23; the introduction passages 22 are connected to corresponding liquid storage bodies 14 containing the same liquid, and the joint passage 23 connects the introduction passages 22 to the ejecting heads 13. Each introduction passage 22 is preferably provided with an on-off valve 24. Hereinafter, the on-off valve 24 provided in the introduction passage 22 connected to the first liquid storage body 14F is referred to as a first on-off valve 24F, whereas the on-off valve 24 provided in the introduction passage 22 connected to the second liquid storage body 14S is referred to as a second on-off valve 24S.

The joint passage 23 is preferably provided with a liquid reservoir 25 that temporarily stores liquid. In this embodiment, the introduction passage 22 connected to the first liquid storage body 14F is joined to the introduction passage 22 connected to the second liquid storage body 14S at the node where both introduction passages 22 are connected to the joint passage 23. Further, the two liquid storage bodies 14 (14F and 14S) are interconnected via a connection passage 26. Thus, the supply passage 15 is provided with: the connection passage 26 via which the liquid storage bodies 14 are interconnected; and the joint passage 23 via which the connection passage 26 is connected to the ejecting heads 13.

The supply mechanism 16 includes a gas delivery passage 28, pressure adjusting valves 29, and a delivery pump 30; the gas delivery passage 28 communicates with the containers 21, the pressure adjusting valves 29 are provided in the gas delivery passage 28, and the delivery pump 30 sends out gas (e.g., air) to the inner spaces of the containers 21. Further, a plurality of delivery pumps 30 may be provided in relation to the containers 21. Alternatively, a single delivery pump 30 may be provided to send out gas to the inner space of the containers 21 via branches of the gas delivery passage 28 formed on its downstream side.

Hereinafter, the pressure adjusting valve 29 provided in the gas delivery passage 28 which communicates with the container 21 containing the first liquid storage body 14F is referred to as a first pressure adjusting valve 29F. Likewise, the pressure adjusting valve 29 provided in the gas delivery passage 28 which communicates with the container 21 containing the second liquid storage body 14S is referred to as a second pressure adjusting valve 29S.

When the delivery pump 30 is driven to send out gas to the gas delivery passage 28, the gas enters a container 21, increasing the inner pressure of the container 21. In response, the bag of the liquid storage body 14 in the container 21 is compressed, thereby applying pressure to the liquid in the liquid storage body 14. As a result, the liquid flows out to the introduction passage 22. In other words, the supply mechanism 16 applies positive pressure energy to the liquid in the liquid storage body 14. In response, the liquid in the liquid storage body 14 flows out to the supply passage 15. The delivery pump 30 can be continuously driven in response to a decrease in the inner pressure of each introduction passage 22, in order to maintain the liquid in each introduction passage 22 at a predetermined positive pressure.

The liquid ejecting apparatus 11 preferably includes a detector 31 that detects whether the amount of liquid left in each liquid storage body 14 is smaller than a preset threshold amount. The detector 31 preferably detects whether the amount of liquid left in each liquid storage body 14 is smaller than the threshold amount, on the basis of a change in the pressure of the liquid in the supply passage 15.

For example, the liquid reservoir 25 includes a movable wall 32 on a part of the wall surface. A movable body 33 moves in accordance with a displacement of the movable wall 32. A first biasing member 34 urges the movable body 33 toward the movable wall 32. A lever 35 is displaced in accordance with movement of the movable body 33. A second biasing member 36 urges the lever 35 toward the movable body 33. In this exemplary configuration, the detector 31 may be implemented using an optical sensor that detects a displacement of the lever 35.

If the pressure of liquid in the supply passage 15 is lower than a preset threshold pressure, the movable wall 32 is displaced toward the inner side of the liquid reservoir 25. In response, the movable body 33 is moved toward the movable wall 32 due to a biasing force from the first biasing member 34. Then, the lever 35 that has been pressed by the movable body 33 is displaced due to a biasing force from the second biasing member 36. An optical sensor implementing the detector 31 detects the displacement of the lever 35.

The detector 31 detects a displacement of the lever 35, when the amount of the liquid in a liquid storage body 14 decreases to an amount smaller than the threshold amount and then lowers the pressure applied to the liquid in the supply passage 15 to a threshold pressure PL. In this way, the liquid ejecting apparatus 11 can detect whether the amount of liquid left in a liquid storage body 14 is smaller than the threshold amount.

If a plurality of ejecting heads 13 are provided, the joint passage 23 may branch off on the downstream side of the liquid reservoir 25, and their branched ends may be connected to the liquid ejector 19 in relation to the respective ejecting heads 13. The pressure adjusting mechanisms 17 may be provided in relation to types of liquid in the ejecting heads 13. For example, if six ejecting heads 13 are provided and four types of liquid are supplied to each ejecting head 13, four pressure adjusting mechanisms 17 may be provided in each ejecting head 13 in relation to the respective types of liquid.

Each pressure adjusting mechanism 17 has a pressure chamber 17*a* communicating with a corresponding ejecting head 13. When an inner pressure of a pressure chamber 17*a* decreases to a negative pressure with consumption of the liquid, the pressure chamber 17*a* permits entry of the liquid to which a pressure is applied in the downstream direction. Therefore, even when the supply mechanism 16 supplies liquid to the supply passage 15 by applying pressure to the liquid, the liquid in a region between a pressure chamber 17*a* and a nozzle 12 is maintained at a predetermined negative pressure.

Next, a description will be given of a configuration of the maintenance apparatus 41. To reduce the risk that the ejecting heads 13 fail to eject liquid due to, for example, clogging of the nozzles 12 or adhering of foreign matter to the nozzles 12, the liquid ejecting apparatus 11 performs a maintenance operation, such as flushing, capping, or suction cleaning, under the control of the controller 100. The maintenance apparatus 41 includes caps 42 that perform capping and a suction mechanism 43 that performs suction cleaning by using the caps 42.

In the flushing, the maintenance apparatus 41 causes the liquid ejecting apparatus 11 to forcibly eject liquid droplets through the nozzles 12 independently of a printing operation, thereby removing foreign matter, bubbles, and altered liquid (e.g., ink thickened due to evaporation of solvent components) that may cause failures in the ejection of liquid. The liquid discharged in the flushing is received by the caps 42.

Each cap 42 is moved relative to a corresponding ejecting head 13 by a moving mechanism (not illustrated) so as to reciprocate between a capping location and an open location. At the capping location, the cap 42 covers an area in which the nozzles 12 are open; at the open location, the cap 42 does not cover the areas. When the caps 42 are positioned at the capping locations, the capping is performed. In addition, when the liquid ejecting apparatus 11 does not eject liquid, the maintenance apparatus 41 performs the capping, controlling drying of the nozzle 12 such that an ejection failure does not occur. When receiving waste liquid in the flushing, the caps 42 are positioned at the open locations.

The suction mechanism 43 includes a suction tube 45, upstream ends of which are connected to the caps 42. The downstream ends of the suction tube 45 are connected to a waste liquid storage section 46. The suction tube 45 is provided with a suction pump 47 at its midway point. The suction tube 45 is further provided with pressure-reducing valves 48 between the suction pump 47 and the caps 42. When the suction pump 47 is driven to apply negative pressure to the spaces covered with the ejecting heads 13 and the caps 42 disposed at the capping locations, liquid in the ejecting heads 13 is sucked toward the nozzles 12 due to the negative pressure and then ejected from the nozzles 12. In this way, the suction cleaning is performed. The liquid ejected from the nozzles 12 in the suction cleaning is received by the waste liquid storage section 46 as waste liquid.

When the liquid ejecting apparatus 11 starts its operation, the delivery pump 30 is driven to create positive pressure inside the containers 21, and then the maintenance apparatus 41 performs the suction cleaning. As a result, liquid is filled in a region between the introduction passages 22 and the nozzles 12, in which the liquid flows. This operation is referred to as initial filling.

Figure 2:
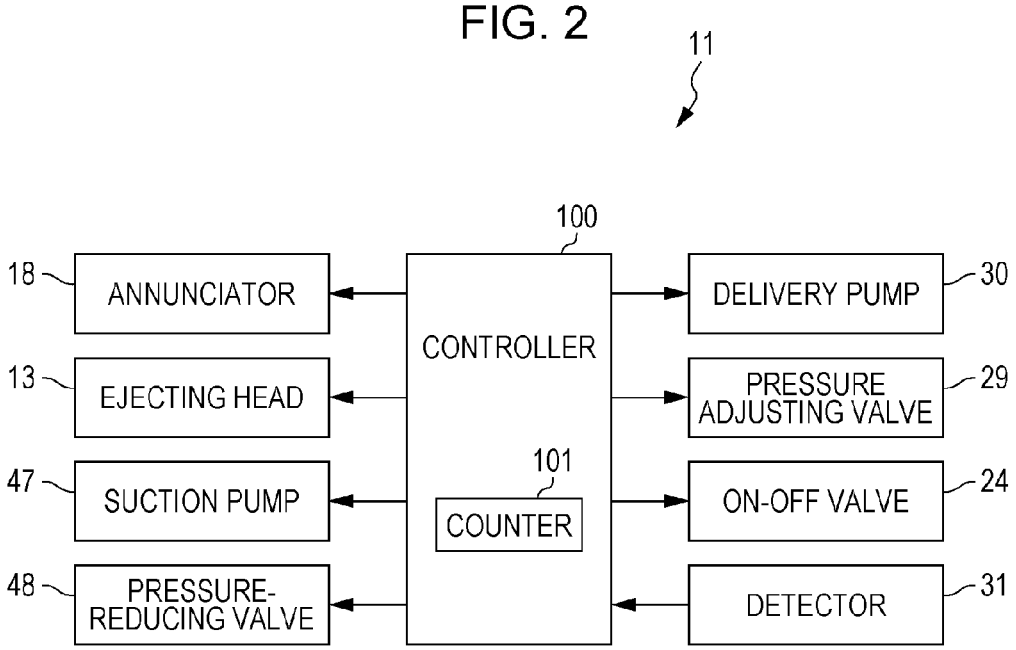
FIG. 2 is a block diagram of an electrical configuration of the liquid ejecting apparatus illustrated in FIG. 1.

Next, a description will be given of an electrical configuration of the liquid ejecting apparatus 11. As illustrated in FIG. 2, the controller 100 in the liquid ejecting apparatus 11 includes a counter 101 that measures time, for example, over which constituent elements are driven. The controller 100 controls driving of the delivery pump 30, of the pressure adjusting valves 29, and of the on-off valves 24 so as to apply pressure to the liquid, thereby supplying the liquid to the ejecting heads 13. During this liquid supply, the controller 100 controls driving of the ejecting heads 13 so as to eject liquid onto the medium S (perform printing on the medium S). Moreover, the controller 100 controls driving of the suction pump 47 and of the pressure-reducing valves 48 such that the maintenance apparatus 41 performs the suction cleaning.

When the detector 31 detects that the amount of liquid left in a liquid storage body 14 is smaller than the threshold amount, the controller 100 switches from this liquid storage body 14 to another liquid storage body 14. When no liquid is about to be left in a liquid storage body 14 in use, the controller 100 causes the annunciator 18 to perform an alarm output operation at a predetermined timing.

Next, a description will be given of an operation of switching between the liquid storage bodies 14 which is performed by the liquid ejecting apparatus 11 configured above. For example, while the liquid ejecting apparatus 11 performs printing on the medium S by using the first liquid storage body 14F, the amount of liquid left in the first liquid storage body 14F becomes insufficient. In response, the liquid ejecting apparatus 11 switches from the first liquid storage body 14F to the second liquid storage body 14S. It should be noted that an operation of switching between the liquid storage bodies 14 may be performed not only during a printing operation but also during a maintenance operation in which liquid is supplied to the ejecting heads 13.

To supply liquid to the ejecting heads 13 in the liquid ejecting apparatus 11, the controller 100 opens both the first pressure adjusting valve 29F and the first on-off valve 24F corresponding to first liquid storage body 14F to be used first. Then, the controller 100 drives the delivery pump 30. In this case, the controller 100 keeps closing both the second pressure adjusting valve 29S and the second on-off valve 24S corresponding to the second liquid storage body 14S to be used next.

The delivery pump 30 sends out and introduces high-pressure gas to only the container 21 housing the first liquid storage body 14F through the gas delivery passage 28. The first liquid storage body 14F thereby selectively receives pressure.

The bag of the first liquid storage body 14F shrinks due to the received pressure. In response, the liquid in the first liquid storage body 14F is discharged to the introduction passage 22 and to the joint passage 23, so that the pressure of the liquid in the supply passage 15 increases. When the detector 31 detects that the pressure of the liquid in the supply passage 15 is as high as or higher than the threshold pressure PL, the controller 100 starts ejecting the liquid through the ejecting heads 13.

Figure 3:
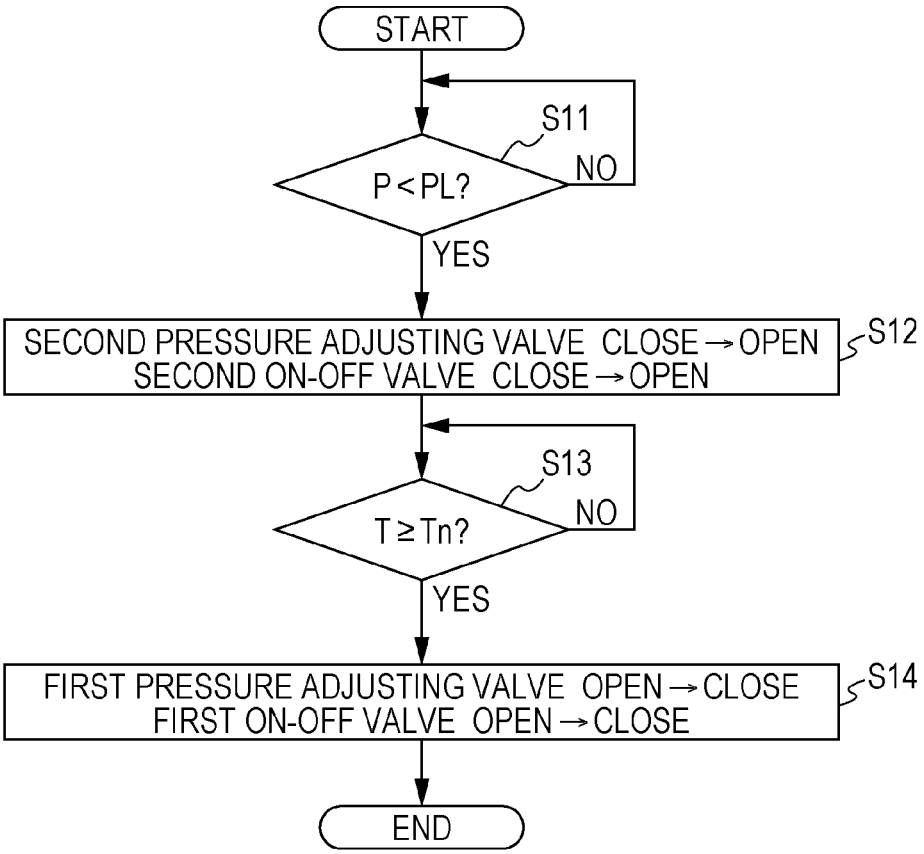
FIG. 3 is a flowchart of a process of switching between the liquid storage bodies in the liquid ejecting apparatus illustrated in FIG. 1.

In response to the supplying and discharging of the liquid, the controller 100 starts switching between the liquid storage bodies 14. As illustrated in FIG. 3, at Step S11, the controller 100 determines whether the detector 31 detects that a pressure P of liquid in the supply passage 15 is lower than the threshold pressure PL.

If the detector 31 does not detect that the pressure P of the liquid in the supply passage 15 is lower than the threshold pressure PL (Step S11: NO), the controller 100 continuously supplies liquid only from the first liquid storage body 14F. If the detector 31 detects that the pressure P of the liquid in the supply passage 15 is lower than the threshold pressure PL (Step S11: YES), the controller 100 proceeds to the process at Step S12.

At Step S12, the controller 100 opens the closed second pressure adjusting valve 29S and second on-off valve 24S that correspond to the second liquid storage body 14S. In short, when the amount of liquid left in the first liquid storage body 14F is smaller than the threshold amount during discharging of liquid onto the medium S, the controller 100 opens the second on-off valve 24S in the introduction passage 22 connected to the second liquid storage body 14S.

The controller 100 adjusts driving power produced by the delivery pump 30 or openings of the pressure adjusting valves 29 (29F and 29S) such that a pressure (second energy) applied to the second liquid storage body 14S is lower than a pressure (first energy) applied to the first liquid storage body 14F. Consequently, liquid in both the first liquid storage body 14F and the second liquid storage body 14S is supplied to the joint passage 23.

At Step S13, the controller 100 causes the counter 101 to measure a time T elapsed from the execution of the process at Step S12 and determines whether the elapsed time T is as long as or longer than a preset transition time Tn.

If the elapsed time T is shorter than the transition time Tn (Step S13: NO), the controller 100 causes the counter 101 to continuously measure an elapsed time T. If the elapsed time T is as long as or longer than the transition time Tn (Step S13: YES), at Step S14, the controller 100 closes the opened first pressure adjusting valve 29F and first on-off valve 24F that correspond to the first liquid storage body 14F. In this case, the controller 100 preferably adjusts driving power produced by the delivery pump 30 or openings of the pressure adjusting valves 29 (29F and 29S) such that the pressure applied to the second liquid storage body 14S increases (the pressure corresponding to the second energy is switched to the pressure corresponding to the first energy). Through the above steps, the operation of switching between the liquid storage bodies 14, through which liquid is supplied to the joint passage 23, is performed, and thus the controller 100 concludes the whole processing.

Figure 4:
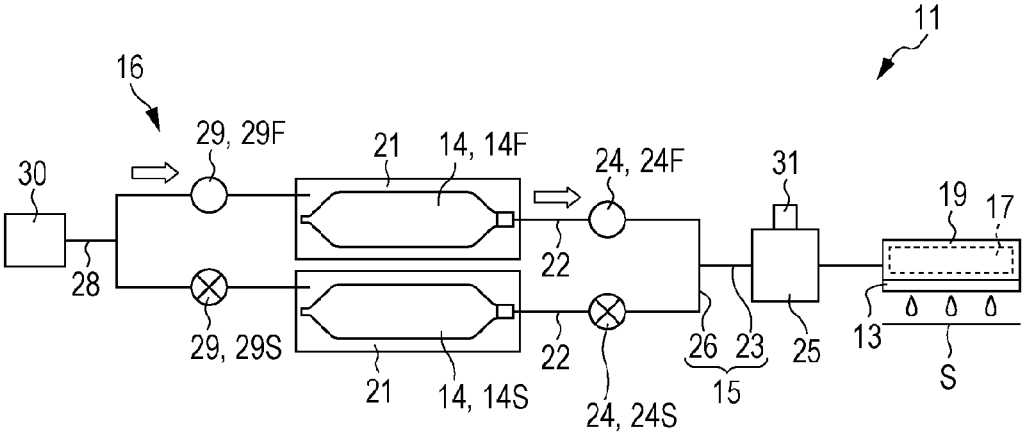
FIG. 4 schematically illustrates the liquid ejecting apparatus illustrated in FIG. 1 when liquid is supplied from the first liquid storage body.

Next, a description will be given of functions of the liquid ejecting apparatus 11 in this embodiment and a liquid supply method using the liquid ejecting apparatus 11. Referring to FIG. 4, a large amount of liquid is left in the first liquid storage body 14F used first in the liquid ejecting apparatus 11. In this case, the controller 100 closes both the second pressure adjusting valve 29S and the second on-off valve 24S, and the supply mechanism 16 supplies the liquid ejector 19 with the liquid in the first liquid storage body 14F on the basis of the first energy.

Figure 5:
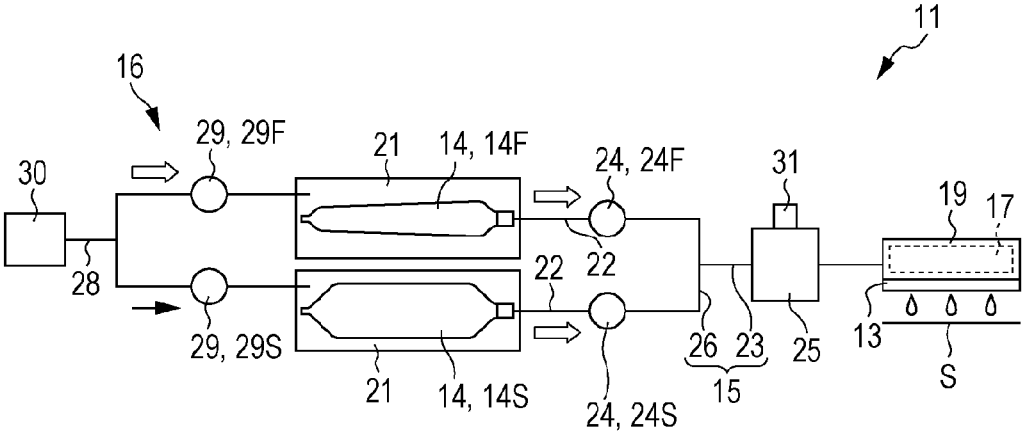
FIG. 5 schematically illustrates the liquid ejecting apparatus illustrated in FIG. 1 when liquid is supplied from both the first and second liquid storage bodies.

Referring to FIG. 5, the liquid ejecting apparatus 11 performs printing on a medium S with liquid that the supply mechanism 16 supplies by applying the first energy to the first liquid storage body 14F, with the amount of liquid left in the first liquid storage body 14F being smaller than the threshold amount. In this case, the controller 100 opens both the second pressure adjusting valve 29S and the second on-off valve 24S. Then, the supply mechanism 16 additionally supplies liquid in the second liquid storage body 14S on the basis of the second energy, which is lower than the first energy.

As described above, when the supply mechanism 16 supplies the supply passage 15 with the liquid in the first liquid storage body 14F on the basis of the first energy, if the amount of liquid left in the first liquid storage body 14F is smaller than the threshold amount, the supply mechanism 16 supplies the supply passage 15 with the liquid in the second liquid storage body 14S on the basis of the second energy, which is lower than the first energy. In short, when the liquid ejecting apparatus 11 ejects liquid onto the medium S, the supply mechanism 16 selectively applies pressure to the plurality of liquid storage bodies 14, thereby supplying liquid.

The supply mechanism 16 can individually remove pressure applied to the liquid storage bodies 14 in order to supply liquid. Therefore, while supplying liquid from the second liquid storage body 14S by applying pressure to the second liquid storage body 14S, the supply mechanism 16 can remove pressure applied to the first liquid storage body 14F. This allows the first liquid storage body 14F to be replaced with a new one.

Liquid is expected to be discharged from a liquid storage body 14 being compressed and deformed. In this case, when the remaining amount Q of liquid decreases to a predetermined amount or below (the liquid is about to be used up), the pressure required to compress the liquid storage body 14 gradually increases as the amount Q decreases.

Figure 6:
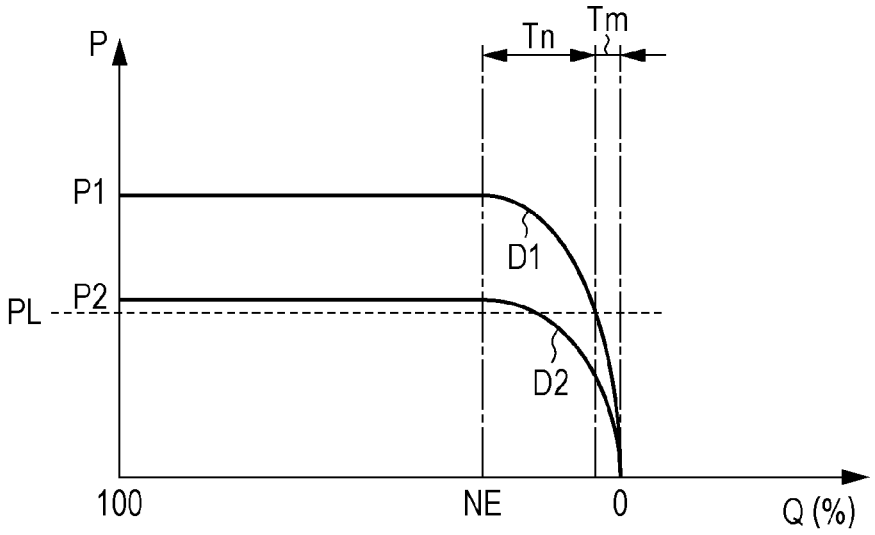
FIG. 6 is a graph showing a relationship between the amount of liquid left in a liquid storage body used in the liquid ejecting apparatus and a pressure of the liquid supplied.

As can be seen from FIG. 6, when a constant pressure (first energy P1) is applied to the first liquid storage body 14F containing an amount Q of liquid, a pressure D1 of the liquid supplied decreases sharply within the region in which the amount Q is smaller than the fixed amount NE.

When the second energy P2, which is lower than the first energy P1, is applied to the second liquid storage body 14S in order to additionally supply liquid, the liquid reliably flows out from the second liquid storage body 14S at a pressure D2 that is as high as or higher than the threshold pressure PL. This is because the second liquid storage body 14S contains liquid in an amount larger than the above amount Q. In this case, the total of the pressure D1 of a decreasing amount of liquid supplied from the first liquid storage body 14F and of the pressure D2 of liquid additionally supplied from the second liquid storage body 14S needs only be set to the threshold pressure PL. Then, the transition time Tn between when the delivery pump 30 starts supplying the liquid from the second liquid storage body 14S and when the delivery pump 30 stops supplying the liquid from the first liquid storage body 14F is preferably set in accordance with time over which the liquid flows out from the first liquid storage body 14F at the first energy P1 during an operation of performing printing on the medium S.

When the liquid is supplied from both the first liquid storage body 14F and the second liquid storage body 14S during the transition time Tn required to switch between the liquid storage bodies 14, the pressure of the liquid in the connection passage 26 is as high as or higher than the threshold pressure PL. Therefore, if the pressure D1 of the liquid that would be supplied from the first liquid storage body 14F decreases to a pressure lower than the threshold pressure PL, the liquid can be no longer discharged from the first liquid storage body 14F. Indeed, by decreasing the pressure of liquid in the connection passage 26, the liquid can be discharged from the first liquid storage body 14F.

Figure 7:
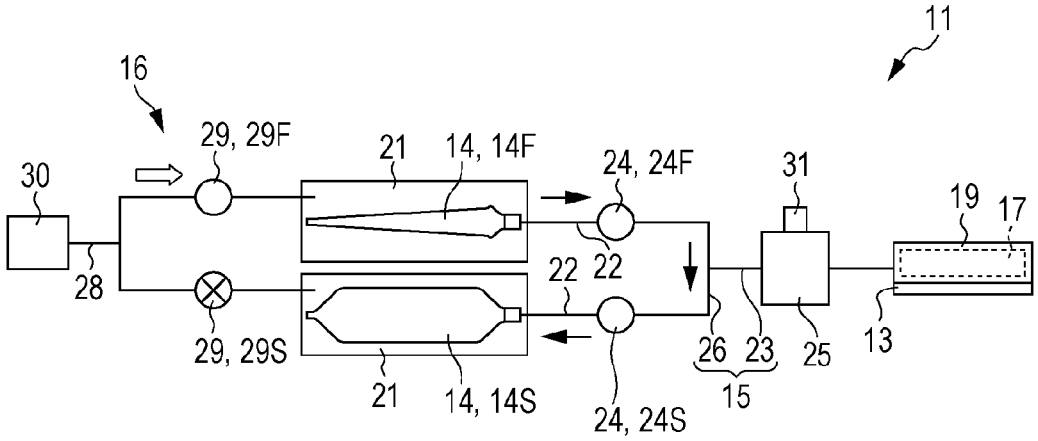
FIG. 7 schematically illustrates the liquid ejecting apparatus illustrated in FIG. 1 when liquid is transferred from the first liquid storage body to the second liquid storage body.

As illustrated in FIG. 7, after liquid has been ejected onto the medium S, it is preferable that the second pressure adjusting valve 29S corresponding to the second liquid storage body 14S be closed so that the pressure applied to the second liquid storage body 14S is removed. As a result, the liquid left in the first liquid storage body 14F to which the pressure is still applied flows out to the second liquid storage body 14S through the connection passage 26. In this case, higher pressure may be applied to the first liquid storage body 14F when the liquid is discharged to the liquid ejector 19.

As described above, while the liquid ejecting apparatus 11 is ejecting liquid onto the medium S, the first on-off valve 24F in the introduction passage 22 connected to the first liquid storage body 14F may be open. After a predetermined time has elapsed from the ejection of the liquid, the first on-off valve 24F may be closed. The remaining liquid in the first liquid storage body 14F is thereby transferred to the second liquid storage body 14S. This can decrease the amount of liquid in the first liquid storage body 14F which is left unused.

To give an example, the liquid ejecting apparatus 11 finishes ejecting liquid, after the amount of liquid left in the first liquid storage body 14F has been lower than the threshold amount for the transition time Tn. In this case, after the time Tm has elapsed from the ejection of the liquid onto the medium S, the annunciator 18 preferably reports to a user that the liquid in the first liquid storage body 14F has been used up. To give another example, the liquid ejecting apparatus 11 finishes ejecting liquid before the time over which the amount of liquid left in the first liquid storage body 14F is lower than the threshold amount reaches the transition time. In this case, after the predetermined time (Tn+Tm) has elapsed from the ejection of the liquid, the annunciator 18 preferably reports to a user that liquid in the first liquid storage body 14F has been used up. This can minimize the amount of liquid left unused in the first liquid storage body 14F by transferring the liquid in the first liquid storage body 14F to the second liquid storage body 14S after the liquid ejecting apparatus 11 has ejected liquid onto the medium S.

Figure 8:
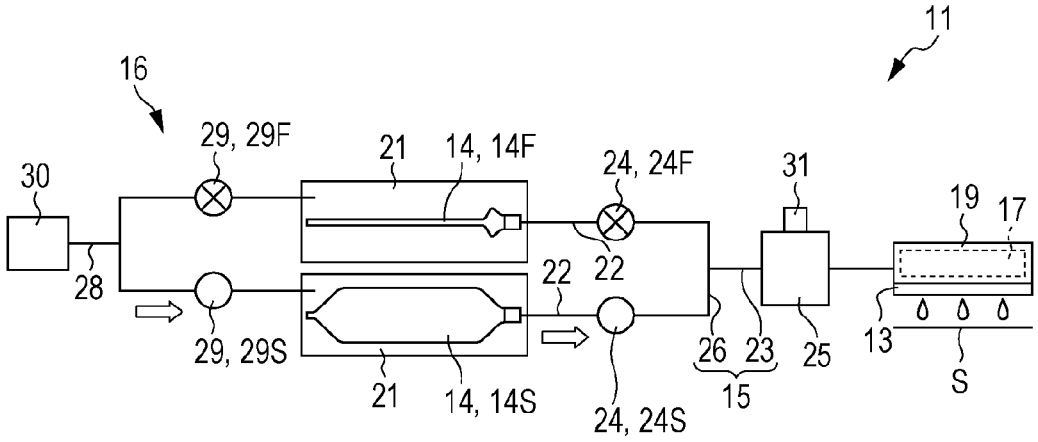
FIG. 8 schematically illustrates the liquid ejecting apparatus illustrated in FIG. 1 when the transfer of liquid from the second liquid storage body to the first liquid storage body starts.

As illustrated in FIG. 8, if the liquid in the first liquid storage body 14F is used up after a printing operation, the delivery pump 30 applies pressure to only the second liquid storage body 14S upon a next printing operation. Thus, the delivery pump 30 can apply pressure efficiently. Furthermore, it is possible to replace the used-up first liquid storage body 14F with a new liquid storage body 14 without interrupting a printing operation.

The effects of the foregoing embodiment will be described below.

(1) The liquid ejecting apparatus 11 switches from the supply of liquid from a first liquid storage body 14F to the supply of liquid from a second liquid storage body 14S without interrupting ejecting of liquid. This is because when the amount of liquid left in the first liquid storage body 14F becomes smaller than a threshold amount, the liquid ejecting apparatus 11 additionally supplies liquid from the second liquid storage body 14S. Furthermore, when the liquid is additionally supplied from the second liquid storage body 14S, an insufficient amount of liquid left in the first liquid storage body 14F is supplied on the basis of energy higher than that applied to the second liquid storage body 14S. The liquid in the first liquid storage body 14F is thereby supplied more powerfully than the liquid in the second liquid storage body 14S. Consequently, it is possible to almost completely consume liquid in the first liquid storage body 14F. Therefore, when supplying liquid from a plurality of liquid storage bodies 14, the liquid ejecting apparatus 11 can switch between the liquid storage body 14 without interrupting the supply of the liquid and can efficiently use the liquid in the liquid storage bodies 14.

(2) The liquid ejecting apparatus 11 supplies liquid at an appropriate pressure. To give an example, a liquid ejecting apparatus determines that the amount of liquid left in a liquid storage body is smaller than a threshold amount, on the basis of the consumption of liquid. If the amount of liquid left in the liquid storage body is smaller than an estimated remaining amount due to, for example, a calculation error, the liquid ejecting apparatus may fail to sufficiently supply the liquid from the liquid storage body. To give another example, a liquid ejecting apparatus determines that the amount of liquid left in a liquid storage body is smaller than a threshold amount, on the basis of a flow rate of the liquid. In this case, the liquid ejecting apparatus may also fail to sufficiently supply the liquid from the liquid storage body, due to variations in the capacities of the liquid storage bodies. However, the liquid ejecting apparatus 11 determines that the amount of liquid left in a liquid storage body 14 is smaller than a threshold amount by detecting a variation in a pressure of the liquid in the supply passage 15 with a detector 31. In this way, the pressure of the liquid supplied is maintained appropriately, independently of an error of a consumption of the liquid or variations in the capacities of the liquid storage bodies 14.

(3) When the liquid ejecting apparatus 11 ejects liquid onto a medium S, a supply mechanism 16 supplies liquid by selectively applying pressure to a plurality of liquid storage bodies 14. More specifically, when the amount of liquid in a liquid storage body 14 is insufficient in the course of ejecting of liquid, the supply mechanism 16 starts applying pressure to the second liquid storage body 14S, thereby additionally supplying liquid from the second liquid storage body 14S. Therefore, the liquid ejecting apparatus 11 can continue to eject liquid independently of the amounts of liquid left in the liquid storage bodies 14. Moreover, the liquid ejecting apparatus 11 can decrease the amount of liquid left unused in the first liquid storage body 14F. This is because the supply mechanism 16 removes the pressure applied to the second liquid storage body 14S after the liquid ejecting apparatus 11 has ejected liquid onto the medium S, thereby transferring the liquid left in the first liquid storage body 14F to which the pressure is still applied to the second liquid storage body 14S through the connection passage 26. Therefore, when the liquid ejecting apparatus 11 ejects liquid onto the medium S next time, the supply mechanism 16 needs only apply pressure to the second liquid storage body 14S. This can make the operation of applying pressure efficient.

(4) The liquid ejecting apparatus 11 uses an annunciator 18 to report that the amount of liquid left in the first liquid storage body 14F is smaller than a threshold amount, after a predetermined time has elapsed from ejection of liquid onto the medium S. Since the annunciator 18 does not give a report immediately after the amount of liquid left in the first liquid storage body 14F becomes smaller than the threshold amount, the liquid left in the first liquid storage body 14F can be used throughout the above predetermined time.

The foregoing embodiment may undergo some modifications as described below. It should be noted that the embodiment and the modifications may be employed in combination.

A supply mechanism 16 may supply liquid from a liquid storage body 14 by pressing a biasing member, such as a plate spring, against a liquid storage bag in the liquid storage body 14. Alternatively, the supply mechanism 16 may include a pump that draws liquid from a liquid storage body 14 and then purges the liquid. In short, the supply mechanism 16 may supply liquid from a liquid storage body 14 by applying either positive or negative pressure to the liquid storage body 14.

The supply mechanism 16 may be provided with a holder that retains a liquid storage body 14 higher than ejecting heads 13. Further, liquid contained in the liquid storage body 14 may be discharged to a supply passage 15 on the basis of the height difference between the liquid storage body 14 and the ejecting heads 13 (the potential energy of the liquid in the liquid storage body 14). In this case, the supply mechanism 16 may move the holder vertically together with the liquid storage body 14, changing the potential energy.

However, the supply mechanism 16 more preferably applies pressure to the bags of liquid storage bodies 14 by individually sending out gas to the inner spaces of containers 21 as in the foregoing embodiment. With this configuration, the supply mechanism 16 can easily and swiftly remove pressure applied to a liquid storage body 14 by stopping sending out gas to the inner space of the container 21 containing the liquid storage body 14 or by making the container 21 communicate with the outside. The configuration in which the supply mechanism 16 applies pressure to the liquid storage bodies 14 by sending out gas to the inner spaces of the containers 21 is suitable, especially for a system in which a small amount of liquid left in a first liquid storage body 14F is transferred to another liquid storage body 14, because this configuration can apply pressure or stop applying pressure easily and swiftly.

Figure 9:
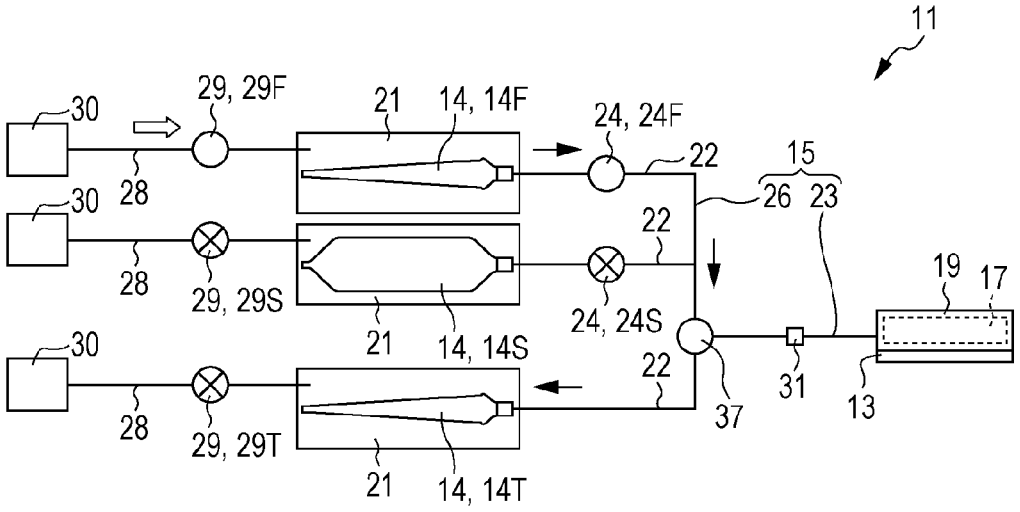
FIG. 9 schematically illustrates a liquid ejecting apparatus in a first modification of the embodiment.

As a first modification illustrated in FIG. 9, in addition to the first liquid storage body 14F to be used first and a second liquid storage body 14S to be used next, a third liquid storage body 14T may be provided as a liquid storage body 14 to which an insufficient amount of liquid left in the first liquid storage body 14F or the second liquid storage body 14S is to be transferred. The third liquid storage body 14T may be initially empty and thus have relatively low initial inner pressure, in which case liquid in the first liquid storage body 14F or the second liquid storage body 14S can be transferred swiftly to the third liquid storage body 14T. In addition, the third liquid storage body 14T may have a different configuration from both the first liquid storage body 14F and the second liquid storage body 14S. For example, the third liquid storage body 14T may have a higher or lower capacity than the first liquid storage body 14F and the second liquid storage body 14S.

Liquid that has been transferred from the first liquid storage body 14F or the second liquid storage body 14S to the third liquid storage body 14T and is to be ejected from nozzles 12 may be used to maintain the ejecting heads 13, instead of performing printing on a medium S. In this case, if liquids having different qualities are transferred from the first liquid storage body 14F and the second liquid storage body 14S to the third liquid storage body 14T, it is possible to suppress the printing quality from being lowered.

In the above configuration, a switching valve 37 is preferably provided at the node at which a joint passage 23 is connected to an introduction passage 22 connected to the third liquid storage body 14T. In addition, the switching valve 37 preferably switches the route of the liquid flowing in the joint passage 23 between the third liquid storage body 14T and the second liquid storage body 14S. The switching valve 37 may be a three-way valve that transfers liquid left in both the first liquid storage body 14F and the second liquid storage body 14S to the third liquid storage body 14T. For example, when the ejecting heads 13 eject liquid through the nozzles 12 during a cleaning operation, the switching valve 37 may set the flow route of the liquid so as to supply the liquid from the third liquid storage body 14T. In this case, the liquid may be supplied only from the third liquid storage body 14T; alternatively, the liquid may be supplied from both the first liquid storage body 14F in use and the third liquid storage body 14T.

There are cases where external gas enters the introduction passage 22 when a liquid storage body 14 is attached to the liquid ejecting apparatus 11. Therefore, before the liquid storage body 14 is attached to the liquid ejecting apparatus 11 and used, liquid is preferably refilled in a flow route from the introduction passage 22 to the nozzles 12, for example. In this case, liquid may be supplied from a plurality of liquid storage bodies 14 (more preferably from all the liquid storage body 14) to the flow route so that the entire gas is purged from the flow route.

A configuration of each liquid storage body 14 may be modified as appropriate. For example, if the supply mechanism 16 supplies liquid in a liquid storage body 14 to the supply passage 15 by means of the potential energy of the liquid, the liquid storage body 14 may have a tank that stores the liquid, instead of a flexible, expandable/contractable bag.

Figure 10:
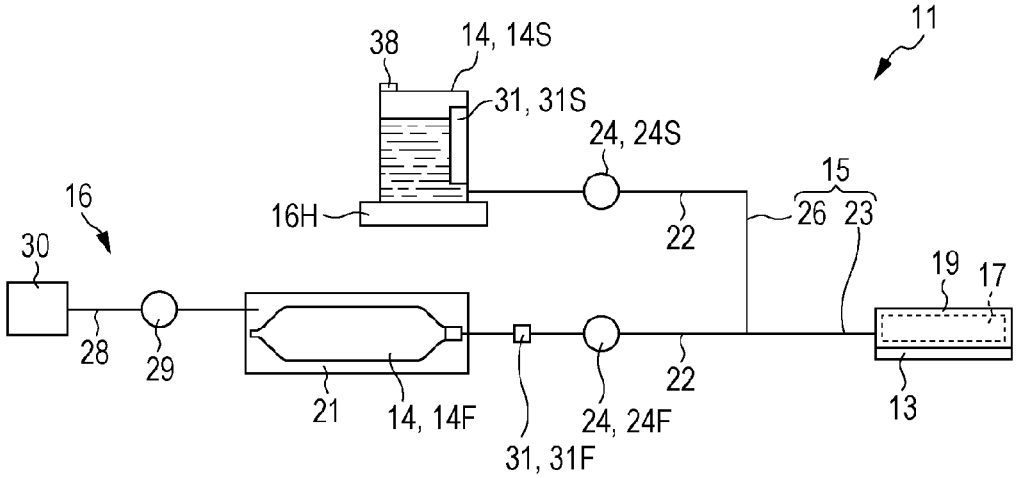
FIG. 10 schematically illustrates a liquid ejecting apparatus in a second modification of the embodiment.

As in a second modification illustrated in FIG. 10, a plurality of liquid storage bodies 14 (14F and 14S) that contain the same liquid may have different structures. Referring to FIG. 10, for example, the first liquid storage body 14F is made of a flexible bag housed in a container 21, similar to the foregoing embodiment, whereas the second liquid storage body 14S is made of a tank that stores liquid, and an injection hole 38 through which the liquid can be injected is created. The first liquid storage body 14F or the second liquid storage body 14S may be fixed to a liquid ejecting apparatus 11.

When the above configuration is employed, the liquid contained in the first liquid storage body 14F is discharged to a supply passage 15 due to pressure energy applied by a supply mechanism 16, similar to the foregoing embodiment. This supply mechanism 16 includes: a gas delivery passage 28 that communicates with the inner space of the container 21; a pressure adjusting valve 29 provided in the gas delivery passage 28; and a delivery pump 30 provided in the gas delivery passage 28.

In this modification, detectors 31 are preferably provided for the respective liquid storage bodies 14. For example, a detector 31 (31F) that detects the amount of liquid left in the first liquid storage body 14F is preferably disposed in the first liquid storage body 14F or in an introduction passage 22 connected to the first liquid storage body 14F. If the second liquid storage body 14S, made of a tank, is employed, a detector 31 (31S) that detects the amount of liquid left in the second liquid storage body 14S may be disposed inside the second liquid storage body 14S.

In this modification, a supply mechanism 16H corresponding to the second liquid storage body 14S includes a holder that retains the second liquid storage body 14S higher than both the first liquid storage body 14F and a liquid ejector 19 (pressure adjusting mechanism 17). When a controller 100 opens a second on-off valve 24S provided in an introduction passage 22 connected to the second liquid storage body 14S, the liquid contained in the second liquid storage body 14S is discharged to a supply passage 15 by means of the potential energy.

When the amount of liquid left in the first liquid storage body 14F is insufficient, the supply mechanism 16 stops applying the pressure energy (first energy) to the first liquid storage body 14F, and the controller 100 opens the second on-off valve 24S. The liquid in the second liquid storage body 14S is thereby supplied to the first liquid storage body 14F by means of the potential energy.

While the liquid ejecting apparatus 11 successively ejects liquid (performs printing), there are cases where the amount of liquid left in the first liquid storage body 14F becomes smaller than a threshold amount with no opportunities to transfer the liquid contained in the second liquid storage body 14S to the first liquid storage body 14F arising. In this case, the supply passage 15 removes the pressure energy (first energy) that the supply mechanism 16 supplies to the first liquid storage body 14F, and the controller 100 closes a first on-off valve 24F, and in turn opens the second on-off valve 24S. As a result, the liquid contained in the second liquid storage body 14S is supplied to the supply passage 15. In addition, ejecting heads 13 preferably eject the liquid at a limited rate, because only the potential energy (second energy) may be unable to ensure the capacity to supply the liquid from the second liquid storage body 14S to the ejecting heads 13. Then, when the liquid ejecting apparatus 11 finishes ejecting liquid (performing printing) while liquid is supplied from the second liquid storage body 14S to the ejecting heads 13, the controller 100 opens the first on-off valve 24F. The liquid in the second liquid storage body 14S is thereby supplied to the first liquid storage body 14F.

In the above way, the liquid ejecting apparatus 11 successfully ejects liquid without replacing the first liquid storage body 14F. When supplied from the second liquid storage body 14S to the first liquid storage body 14F, the liquid is stirred inside the first liquid storage body 14F. Therefore, even if the liquid contains a sedimentary component, such as a pigment, the sedimentary component is less likely to settle down in the first liquid storage body 14F, thereby reducing a nonuniform concentration of the liquid. Moreover, in order to stir the liquid in the first liquid storage body 14F, the liquid may be transferred from the second liquid storage body 14S to the first liquid storage body 14F not only at the timing when the amount of liquid in the first liquid storage body 14F is insufficient but also at any other predetermined timings. Examples of such predetermined timings include: when the liquid ejecting apparatus 11 is powered; after the liquid ejecting apparatus 11 has performed a printing operation; after the ejecting heads 13 have been maintained; and after the liquid has been supplied to the second liquid storage body 14S. By transferring the liquid at one of the above timings, a large amount of liquid is kept in the first liquid storage body 14F.

In the second modification illustrated in FIG. 10, for example, the first liquid storage body 14F may be made of an irreplaceable tank, and the second liquid storage body 14S from which the liquid is to be transferred to the first liquid storage body 14F may be a detachable cartridge (or a flexible bag housed in the container 21). With this configuration, while liquid is supplied from the first liquid storage body 14F to the ejecting heads 13, the second liquid storage body 14S can be replaced with a new one without an interruption of ejecting of liquid.

In the foregoing embodiment, the controller 100 may open the first on-off valve 24F in the introduction passage 22 connected to the first liquid storage body 14F when the liquid ejecting apparatus 11 ejects liquid onto the medium S, but may close the first on-off valve 24F after the predetermined time Tm has elapsed from the ejection of the liquid. In this case, after the liquid ejecting apparatus 11 has ejected the liquid onto the medium S, the controller 100 closes both the second pressure adjusting valve 29S corresponding to the second liquid storage body 14S and the second on-off valve 24S in the introduction passage 22 connected to the second liquid storage body 14S. Since the pressure is applied to the liquid left in the first liquid storage body 14F, this liquid is transferred to the liquid reservoir 25.

When the amount of liquid left in the first liquid storage body 14F becomes smaller than the threshold amount during ejecting of liquid onto the medium S, the controller 100 opens the second on-off valve 24S in the introduction passage 22 connected to the second liquid storage body 14S. As a result, the liquid contained in the second liquid storage body 14S is allowed to flow out to the joint passage 23. Furthermore, the controller 100 opens the first on-off valve 24F in the introduction passage 22 connected to the first liquid storage body 14F upon ejecting of liquid onto the medium S. The liquid contained in the first liquid storage body 14F is thereby allowed to flow out to the joint passage 23. After a predetermined time has elapsed from the ejection of liquid, the controller 100 closes the first on-off valve 24F in the introduction passage 22 connected to the first liquid storage body 14F. During this elapsed time, the liquid left in the first liquid storage body 14F flows out to the liquid reservoir 25 provided in the joint passage 23. This decreases the amount of liquid left in the first liquid storage body 14F that has been used. In this case, since pressure applied to the second liquid storage body 14S is not removed, the supply mechanism 16 can start supplying liquid swiftly from the second liquid storage body 14S upon a next liquid ejection.

After having performed a printing operation, in many cases, the liquid ejecting apparatus 11 performs a maintenance operation that involves ejecting liquid from the ejecting heads 13. Consuming the liquid in this maintenance operation decreases an inner pressure of the liquid reservoir 25. This enables the supply mechanism 16 to supply the liquid from the first liquid storage body 14F to the liquid reservoir 25.

In the above case, after a predetermined time has elapsed from ejection of liquid onto the medium S, the annunciator 18 preferably also reports that no liquid is left in the first liquid storage body 14F. This elapsed time is preferably set such that the entire liquid left in the first liquid storage body 14F flows out to the liquid reservoir 25. This can minimize the amount of liquid left in the first liquid storage body 14F by discharging the entire liquid in the first liquid storage body 14F to the liquid reservoir 25 after ejecting of liquid onto the medium S.

If liquid in the first liquid storage body 14F does not need to be transferred to other liquid storage bodies 14 and the liquid reservoir 25, a single way valve may be used as the on-off valve 24. This single way valve allows liquid to flow in the direction from the liquid storage bodies 14 to the joint passage 23 but blocks the liquid from flowing in the reverse direction. In this case, the controller 100 can determine from which liquid storage body the liquid is to be supplied, by selectively applying pressure to the liquid storage bodies 14.

When the amount of liquid left in the first liquid storage body 14F is insufficient, a user may determine whether to additionally supply liquid from the second liquid storage body 14S and whether to transfer the liquid left in the first liquid storage body 14F to the second liquid storage body 14S or to the liquid reservoir 25.

The detector 31 is not limited to an optical sensor and may have any given configuration. For example, the detector 31 may be a software counter that determines whether the amount of liquid left in a liquid storage body 14 is smaller than a threshold amount, on the basis of the consumption of liquid. Alternatively, liquid remaining sensors may be disposed in the respective liquid storage bodies 14.

The annunciator 18 is not limited to a liquid crystal panel or some other display unit and may have any given configuration. For example, the annunciator 18 may be: an alarm indicator using light or voice or buzzing sound, which is turned on/off when the amount of liquid left in a liquid storage body 14 is smaller than a threshold amount; or a computer with a monitor which is connected as a host device to the liquid ejecting apparatus 11.

The ejecting heads 13 in the liquid ejecting apparatus 11 are not limited to liquid ejectors (line scan heads) whose printing area covers the whole width of the medium S. Alternatively, the ejecting heads 13 may be serial type heads that alternately perform an ejection operation and a transport operation; in the ejection operation, the heads eject liquid while the carriages that retain the heads reciprocate in the width directions of the medium S, and in the transport operation, the heads are transported in a direction that intersects the width directions of the medium S.

Liquid to be ejected from the ejecting heads 13 is not limited to ink and may be a liquid body created by dispersing or mixing particles of a functional material in a liquid. For example, this liquid body may contain dispersed or dissolved particles of an electrode material, a color material (pixel material) or others, which are used to fabricate liquid crystal displays, EL (electroluminescent) displays, surface emitting displays. The liquid ejecting apparatus 11 may make records by ejecting this liquid body.

The medium S is not limited to a paper sheet and may be a plastic film, a thin plate material, or fabric or clothes used by textile printing apparatuses, for example.

A technical idea that can be conceived of from the foregoing embodiment and modifications will be described below.

A liquid ejecting apparatus includes: an ejecting head and a supply passage. Liquid is ejected through the ejecting head. The ejecting head is connected to a plurality of liquid storage bodies via the supply passage. The plurality of liquid storage bodies include a first liquid storage body and a second liquid storage body. The liquid is supplied from the first liquid storage body and the second liquid storage body to the ejecting head.

With the above configuration, when the amount of liquid contained in the first liquid storage body which is supplied to the ejecting head is insufficient, the liquid contained in the second liquid storage body is supplied to the first liquid storage body. Therefore, the first liquid storage body does not need to be replaced with a new one so frequently. When the first liquid storage body is replaced with a new one, gas may enter the supply passage. To prevent this disadvantage, the liquid ejecting apparatus needs to perform a cleaning operation by replacing the liquid staying in the supply passage with new liquid. This cleaning operation is prone to consume a considerable amount of liquid. The above configuration enables the first liquid storage body to be replaced less frequently, thereby reducing a consumption of liquid during the cleaning operation.

When the liquid contained in the second liquid storage body is supplied to the first liquid storage body, the liquid contained in the first liquid storage body is stirred. Stirring the liquid in this manner reduces the risk that a sedimentary substance, such as a pigment, contained in the liquid increases nonuniform concentration.

The entire disclosure of Japanese Patent Application No. 2015-135028, filed Jul. 6, 2015 is expressly incorporated by reference herein.

What is claimed is:

1. A liquid ejecting apparatus comprising:

an ejecting head through which liquid is ejected;

a supply passage connecting the ejecting head to a plurality of liquid storage bodies, the liquid storage bodies including a first liquid storage body and a second liquid storage body, the first liquid storage body to be used first, the second liquid storage body to be used following the use of the first liquid storage body; and a supply mechanism discharging the liquid contained in the liquid storage bodies to the supply passage, when the supply mechanism discharges the liquid contained in the first liquid storage body to the supply passage on the basis of first pressure applied to the first liquid storage body, if the amount of liquid left in the first liquid storage body is smaller than a threshold amount, the supply mechanism discharges the liquid contained in the second liquid storage body to the supply passage on the basis of second pressure applied to the second liquid storage body while maintaining the first pressure to the first liquid storage body, the second pressure being lower than the first pressure.

2. The liquid ejecting apparatus according to claim 1, further comprising a detector that detects whether the amount of liquid left in the liquid storage bodies is smaller than the threshold amount by detecting a change in pressure of the liquid in the supply passage.

3. The liquid ejecting apparatus according to claim 1, wherein the supply passage includes a connection passage interconnecting the plurality of liquid storage bodies and a joint passage connecting the connection passage to the ejecting head, when the liquid is ejected onto a medium, the supply mechanism supplies the liquid at a high pressure by selectively applying pressure to the plurality of liquid storage bodies, and after the liquid has been ejected onto the medium, the supply mechanism discharges the liquid from the first liquid storage body to the second liquid storage body through the connection passage by removing the pressure applied to the second liquid storage body and by continuing to apply the pressure to the first liquid storage body.

4. The liquid ejecting apparatus according to claim 1, wherein the supply passage includes a plurality of introduction passages connected to the respective liquid storage bodies and a joint passage connecting the plurality of introduction passages to the ejecting head, each of the introduction passages is provided with an on-off valve, the joint passage is provided with a liquid reservoir that temporarily stores the liquid, when the ejecting head ejects the liquid onto the medium with the on-off valve in one of the introduction passages which is connected to the first liquid storage body is opened, if the amount of liquid left in the first liquid storage body is smaller than the threshold amount, the on-off valve in one of the introduction passages which is connected to the second liquid storage body is opened, and the supply mechanism additionally supplies the liquid from the second liquid storage body, and after a predetermined time has elapsed from the ejection of the liquid onto the medium, the on-off valve in the introduction passage connected to the first liquid storage body is closed.

5. The liquid ejecting apparatus according to claim 1, further comprising an annunciator that reports whether the amount of liquid left in the liquid storage bodies is smaller than the threshold amount, wherein when the amount of liquid left in at least one of the liquid storage bodies is smaller than the threshold amount, the annunciator gives a report after a predetermined time has elapsed from the ejection of the liquid onto the medium.

6. A liquid supply method of supplying liquid from a plurality of liquid storage bodies, the liquid storage bodies including a first liquid storage body to be used first and a second liquid storage body to be used following the use of the first liquid storage body, the liquid supply method comprising:

supplying the liquid contained in the first liquid storage body on the basis of first pressure applied to the first liquid storage body; and additionally supplying the liquid contained in the second liquid storage body on the basis of second pressure applied to the second liquid storage body while maintaining the first pressure to the first liquid storage body when the amount of liquid left in the first liquid storage body is smaller than a threshold amount, the second pressure being lower than the first pressure.

* * * * *